United States Patent [19]

Reddig

[11] Patent Number: 4,662,070

[45] Date of Patent: May 5, 1987

[54] FLOOR COVERING CUTTER

[76] Inventor: Bernd Reddig, Dorstrasse 13, 2841 Drebber, Fed. Rep. of Germany

[21] Appl. No.: 843,098

[22] Filed: Mar. 24, 1986

[30] Foreign Application Priority Data

Mar. 27, 1985 [DE] Fed. Rep. of Germany ..... 3511091

[51] Int. Cl.[4] ..... B26B 5/00

[52] U.S. Cl. ..... 30/294; 30/125; 30/332

[58] Field of Search ..... 30/294, 125, 317, 330, 30/331, 332, 162, 329

[56] References Cited

U.S. PATENT DOCUMENTS

| | | | |
|---|---|---|---|
| 2,679,100 | 5/1954 | Ehler | 30/125 X |
| 3,845,554 | 11/1974 | Joanis et al. | 30/125 |
| 3,918,158 | 11/1975 | Debski | 30/317 X |
| 3,965,575 | 6/1976 | Stunger | 30/294 |
| 4,068,375 | 1/1978 | Rathbun et al. | 30/125 |
| 4,109,380 | 8/1978 | Anderson | 30/125 |
| 4,261,104 | 4/1981 | Cuscovitch | 30/330 |
| 4,277,888 | 7/1981 | Szabo | 30/162 |
| 4,604,805 | 8/1986 | Krieger | 30/125 X |

*Primary Examiner*—Jimmy C. Peters

*Attorney, Agent, or Firm*—McGlew and Tuttle

[57] ABSTRACT

A floor covering cutter for cutting floor coverings such as carpets, has a shell handle (3) consisting of several parts and a cutting blade (6) that is gripped with its cutting head at an angle of deployment with respect to the longitudinal axis of the shell handle between the shell parts of the handle that are connected with a screw. They enclose a storage area (12) for spare blades on the inside and present a gripping contour on the outside. The cutting blade is positioned with its cutting head at a slight forward angle of deployment with respect to the theoretical mid longitudinal axis (7) of the handle shell, while the handle shell, on the end opposite from the cutting blade (6), presents a steadily expanding outer cross-section (4) with flattened contours in the area adjoining the gripping surface (3). In the storage area (12) are kept blades standing on one edge. The two shell parts (1,2) are connected by a joint and held together by a knurled screw (10).

17 Claims, 7 Drawing Figures

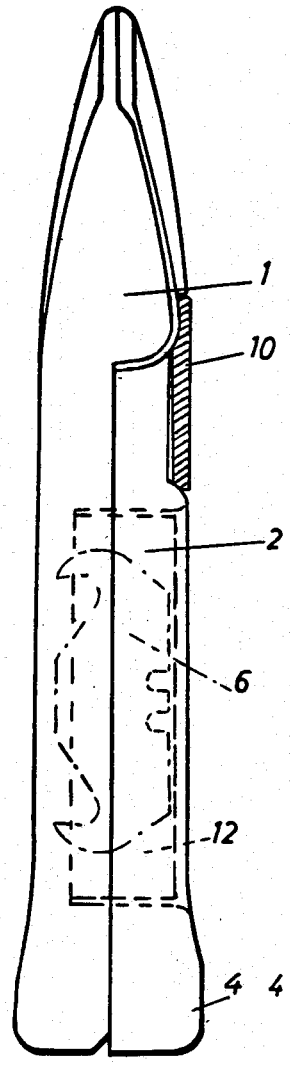
Fig. 2
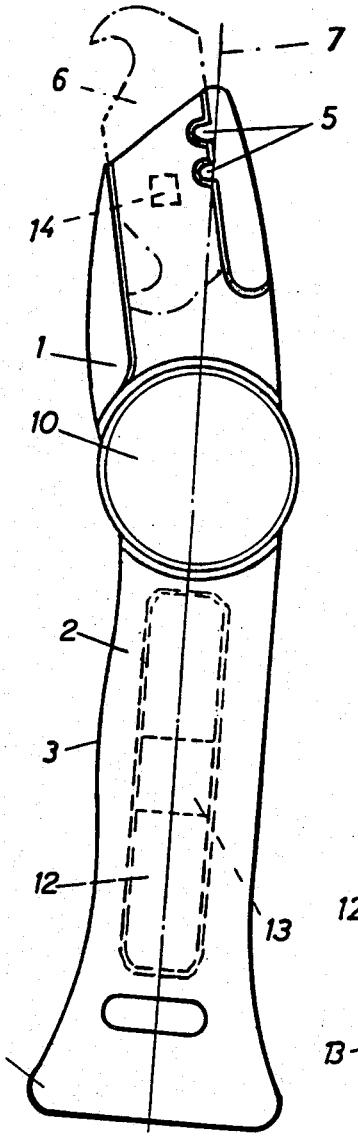
Fig. 1
Fig. 3
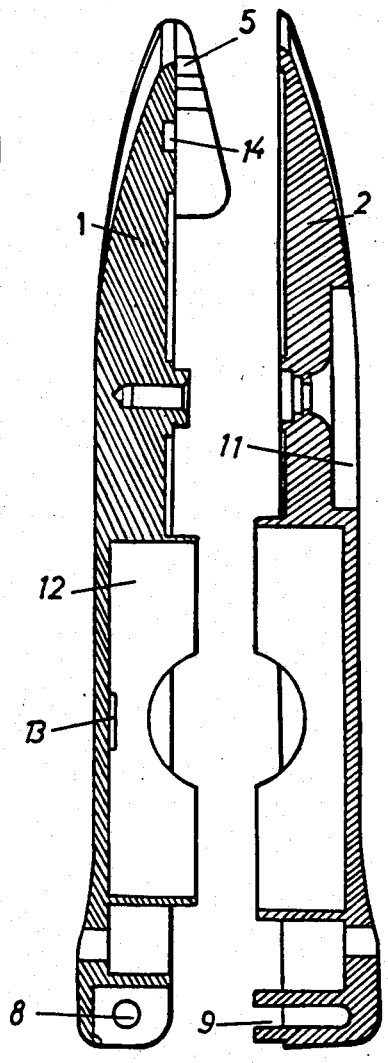

FLOOR COVERING CUTTER

FIELD AND BACKGROUND OF THE INVENTION

The present invention relates in general to utility knives, and in particular to a new and useful cutter for cutting floor coverings. The cutter comprises a shell handle consisting of several parts and a cutting blade that is gripped with its cutting head at an angle of deployment to the longitudinal axis of the shell handle between the parts thereof. The parts can be joined by a screw and enclose an inner storage area for spare blades and are contoured on the outside into a grip shape.

Floor covering or carpet cutters with a shell handle in two halves, with the two halves joinable together by one or two screws are known, where the screw heads are countersunk and have a slot to accommodate a screwdriver, a coin or the like, in order to separate the shell parts to change the cutting blades and then to join them back together. The cutting blade, which must be changed relatively frequently, sits in a mounting structure at one end of the shell handle and is gripped between the two parts of the shell. Projections on the inside of the shell parts engage recesses in the cutting blade and insure that the blade is held tightly and securely in the shell handle. In prior art floor covering cutters, the cutting blade projects out of the shell handle as an approximately straight extension (British Pat. No. 1,020,485), or is deployed at an angle of approximately 45° with respect to the longitudinal axis of the shell handle (U.S. Pat. No. 3,965,575). The shell handle is subjected to considerable force and is therefore frequently made of injection molded aluminum or a comparably strong material. Known shell handles are usually flat in cross-section and have only an approximation of hand grip contours, which on the non-blade end taper keel-like to one sided nose curve (British Pat. No. 1,020,485). The flattened contour of the grip formation of the shell handle has the practical advantage that there is room inside the shell handle for a storage space for spare blades, which lie inside it in a stack, but has the disadvantage that when great force is applied, the user feels mildly painful points of press in his hand. Also known from the above-mentioned literature, however, are handles for such floor covering cutters that are round in cross-section but of only one piece. Then, however, there is no storage space for spare blades and the disadvantage is incurred that the cutter is harder to guide with the hand.

SUMMARY OF THE INVENTION

The present invention seeks to solve the forementioned problems by changing the shape of the shell handle and designing its structure differently to make manipulating the floor covering cutter easier and improve handling when cutting.

The invention proposes to solve these problems by having the cutting blade form with its straight edge next to the cutting head, a slight forward angle of deployment of from 5° to 8°, and 10° at most, with respect to the theoretical mid-longitudinal axis of the handle shell, and having a handle shell with a cross-section through the middle with roughly equal extension along the axes of an imaginary coordinate system, which transitions on the end farthest from the cutting blade to an outer cross-section steadily expanding on all sides in the area adjacent to the gripping surface.

The small forward angle of deployment of approximately 5° to 8° or 10° reduces the amount of force needed to cut, and at the same time the shell handle is easier and more secure to hold, thanks to the expansion of the cross-section. Since the cutter is drawn as it cuts, the user's hand closed around the shell handle finds a better support on the shell handle and expecially against the rear bulge of the handle profile. This intended effect can be enhanced by the fact that the shell handle is designed in the gripping area, particularly in the area of the end farthest from the cutting blade where the outer cross-section steadily expands, with outer contours that approximate a rectangle in cross-section. In addition, the cross-section of the handle shell is thereby made larger (thicker) and fits the hand of the user better than conventional floor covering cutters with a flat handle profile. It is of special significance, moreover, that the rear expansion of the cross-section of the handle shell offers the possibility, particularly for long cuts, of guiding the flooring cutter with one hand in conventional fashion while grabbing onto the back, hump-forming expanded cross-section of the shell handle on the free end with the thumb and bent index finger of the other hand, thus increasing drawing power while a cut is being made or taking some of the burden off the leading hand. The floor covering cutter can thus, with this design, be gripped with both hands.

The thicker design of the shell handle resulting from these characteristics of the invention make it possible to create a storage space inside the shell handle in which the spare blades are kept standing on edge, so that the spare blades can be removed much more readily out of the storage space than is the case with the conventional flat storage position. For the same reason, namely, the thicker cross-sectional shape of the shell handle, the two parts of the shell can be joined together on the end away from the blade by a joint, which is integrated into the shell handle without projecting parts, so that the two shell parts can no longer fall apart when the shell handle is opened to change the blade, which results in a substantial improvement in the handling of the cutter. Finally, the shape of the handle with the characteristics of the invention makes it possible to hold the two parts of the handle together with a larger knurled screw, the edge of which projects beyond the contour of the handle shell on two sides opposing one another roughly diametrically with respect to the axis of rotation of the knurled screw and can be grasped with the fingers of one hand. Such a knurled screw makes it unnecessary to use tools to change blades, but nevertheless does not interfere in any way with the handling of the floor covering cutter during use.

In one preferred embodiment, the graspable parts of the knurled screw should be placed approximately in the middle of the shell handle with respect to the axis of rotation of the screw and should project beyond the shell handle on the side opposite the angle of deployment.

With this design, with minimal bodily force substantial torque can be exerted on the screw holding together the shell parts and the clamping tension on the cutting blade increased. This is achieved by pushing the knurled edge of the screw that projects beyond the shell handle against a firm counter-surface, such as the foor, in order to tighten or loosen the screw, depending on the direction of the push, by means of the torque thus produced. This characteristic not only makes it possible to exert greater turning power on the screw, however, but also speeds up turning when tightening and loosening the cutting blade. To achieve this end, the knurled screw need only project with its knurled edge beyond the shell handle to the side opposite the angle of deployment. On this side, the shell handle, in one specific embodiment, is profiled as a curved ridge, so that the knurled screw with its knurled edge can be very readily pushed across the floor or another firm surface with the shell handle held in one hand. In another preferred embodiment, the screw, equipped with a knurled rim, has a threaded stem that engages with a counter thread in one of the shell parts. In the other shell part the screw is seated so that it can turn freely but cannot shift axially, so that by turning the screw the two shell parts are screwed together and by this means can be tightened against one another or separated.

Another special feature of the floor cutter pursuant to the invention is that on the bottom of the storage space for spare blades and in the area of the mounting structure for the cutting blade in cutting position, permanent magnets are positioned that hold the cutting blades firmly on the one hand in the storage space and on the other hand in the mounting device between the two handle shells, so that they can be moved from their respective positions only by applying a small amount of force.

Accordingly, an object of the present invention is to provide a utility knife or floor covering cutter which comprises a pair of shell portions which together form a shell handle defining a storage space therein, means for holding the shell portions together, the shell portions having a middle longitudinal axis and a slot for receiving a cutting blade which extends at an angle of at most 10° and preferably from 5° to 8° with respect to the longitudinal axis of the shell handle. The cross-section of the handle intermediate its length is curved, for example, circular or eliptical. The cross-section lodges toward an end of the handle opposite from the blade channel, this end being preferably rectangular in cross-section.

A further object of the invention is to provide a cutter or utility knife which is simple in design, rugged in construction and economical to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

BRIEF DESCRIPTION OF THE DRAWINGS

In the drawings, a few embodiments of the invention are depicted as follows:

FIG. 1 is a side view of a floor covering cutter;

FIG. 2 is a front view turned 90° with respect to FIG. 1;

FIG. 3 is a longitudinal sectional view through the two shell parts of the cutter;

DESCRIPTION OF THE PREFERRED EMBODIMENTS

Figure 4:
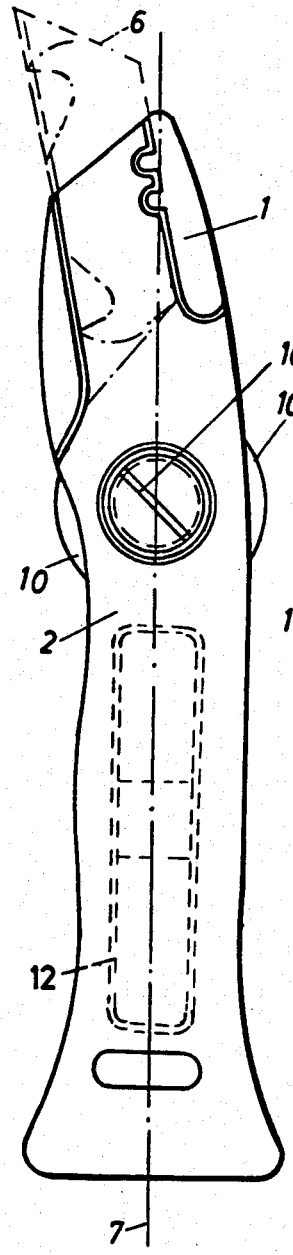
FIG. 4 is a side view of another embodiment of a floor covering cutter.

In the embodiment depicted in FIGS. 1 to 3, the shell handle of the floor covering cutter may be made of plastic, for example, or conventionally of aluminum or the like. The dividing line of the shell handle is approximately in the middle. Both shell parts 1 and 2 have projections on the inside and corresponding recesses on the other part, so that the two shell parts 1 and 2 are joined together so that they cannot be displaced. In the center the handle shell forms a relatively thick handhold with approximately round, e.g., circular, elliptical or similarly profiled cross-sectional contours. This handle shape or contour 3 of the cutter transitions into a steady expansion 4 of the outer cross-section. In the area of this expansion 4, however, the cross-sectional contours more closely approach the shape of a rectangle, so that flattened outer surfaces result that can be grasped lightly with the thumb and bent index finger of one hand.

The opposite end of the handle shell has mounting means 5 of a conventional kind in itself for a cutting blade 6 drawn in with a dotted line. In contrast to conventional arrangements, one shell half 1 is provided with an especially deep insert for the cutting blade 6, so that when the cutting blade 6 is inserted, the other shell part 2 is still engaged somewhat in the sunken recess for the reception of the cutting blade 6 in the other shell part 1. This achieves particularly secure clamping of the cutting blade and which prevents faulty clamping of the cutting blade 6 and injuries to the user resulting therefrom. This cutting blade 6 is placed with its cutting head at a forward angle of deployment with respect to the theoretical midlongitudinal axis 7 of the handle shell. This angle of deployment should be between 5° and 8°. The recess or channel in the shell handle for blade 6 must also extend at this cycle.

For assembly, the two shell parts 1 and 2 are connected together at their free end by a joint consisting of a link pin 8 on the one shell part 1 and a fork 9 that fits over it on the other shell part 2. In addition, the two shell parts can be screwed together near the mount for the cutting blade 6 by means of a knurled screw 10. The head of screw 10 in the embodiment in FIGS. 1 through 3 is positioned so that it can be countersunk in part 2 and its shaft can be screwed into a thread in the other part 1. The knurled screw is positioned with its graspable head or edge 10 in the countersink 11 in such a way that it projects beyond the contour of the handle on two opposite sides, as FIG. 1 clearly shows. In these areas, the head 10 of the knurled screw may be gasped and turned with two fingers of one hand. The force thereby applied is sufficient to screw securely the two parts 1 and 2 of the handle shell.

Figure 5:
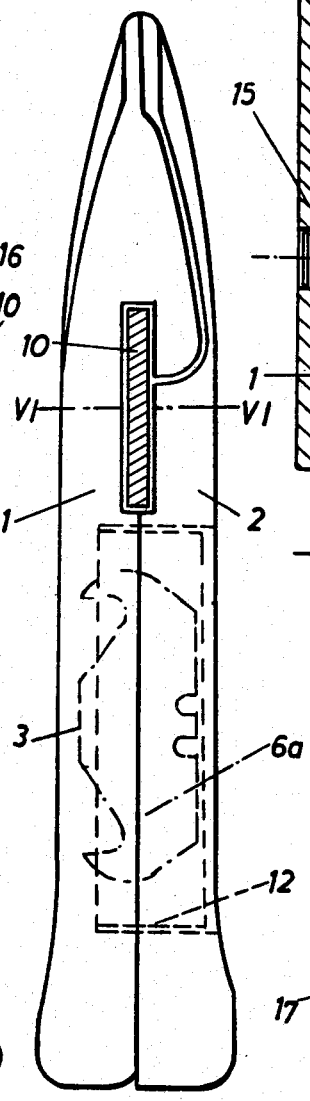
FIG. 5 is a front view of the cutter turned 90° with respect to FIG. 4.
Figure 6:
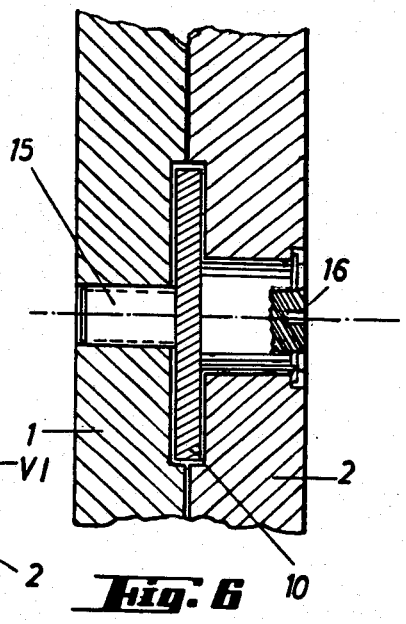
FIg. 6 is an enlarged sectional detail taken along line VI—VI in FIG. 5.

In the preferred configuration shown in the embodiment of FIGS. 4 through 6, the knurled screw 10 is placed approximately in the middle in a recess between the two shell parts 1 and 2. Thus knurled screw 10 engages with its thread 15 with a counterthread in one of the shell parts 1 and is seated with its other end in the other shell part 2 in such a way that it can turn freely but cannot shift axially. The knurled edge of the knurled screw 10 projects beyond the shell handle on one side or on two opposite sides. It is sufficient, however, if the knurled edge projects on the side opposite the angle of depoloyment of the cutting blade 6 with respect to the longitudinal axis 7 of the shell handle, specifically, where the shell handle forms a bend in its back, as it were, which is clear from the depiction in FIGS. 1 and 4.

Figure 7:
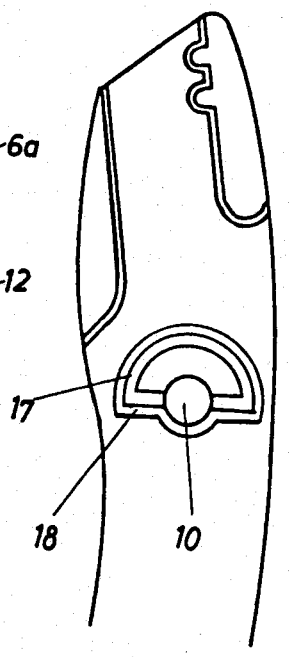
FIG. 7 is a partial side view of an embodiment which is modified with respect to FIGS. 4 and 6.

In the illustrated embodiment of FIGS. 4 to 6, the one open face of the shaft of the knurled screw 10 is provided with a slit 16 or a comparable configuration accommodating a tool, so that the screw 10 can, if necessary, be operated with the help of a tool. The screw may also be operated by means of an operating member as shown in FIG. 7. That embodiment shows an operating member as a type of wing nut 17, which can be raised out of a countersunk rest position in a recess 18 and then grasped by the hand to operate the screw. Such a wing nut 17 can be used instead of the slit 16 shown in FIG. 4 to receive a screwdriver or the like in conjunction with a knurled edge on the screw 10, or without such a knurled edge. After the knurled screw is loosened, the two shell parts 1 and 2 can be swung open at the joint 8, 9, so that the cutting blade 6 can be changed.

Spare blades are kept in a storage space 12 inside the handle shell, in which the cutting blades are positioned upright, that is perpendicular to the blade 6 in the cutting position, so that they can be grasped between two fingers and removed from the storage space. In order to keep the spare blades in their upright position in the storage space, a permanent magnet 13 is positioned on the bottom of the storage space 12 that attracts the spare steel blades and holds them in position. A similar permanent magnet 14 is provided in the area of the mounting means 5 for the cutting blades 6 in cutting position, so that the cutting blade 6 does not fall out of position when the handle shell is opened. A small amount of force must be exercised to remove cutting blade 6. On the other hand, as a replacement blade 6 is put in, it is drawn ito holding position by the magnet 14, so that changing blades is made considerably easier.

Accordingly, the invention is a utility knife comprising:

a pair of shell parts (1,2) engaged with each other to form a shell handle having an inner storage space (12) for a plurality of cutting blades (6) and an outer contour (3,4), said shell handle having a mid longitudinal axis (7) and one end with a blade receiving channel for receiving a blade in a cutting position, said blade receiving channel extending at from about 5° to about 10° with respect to said mid longitudinal axis;

said shell handle having another end opposite from said one end with said blade receiving channel, said contour having outer cross section transverse to said mid longitudinal axis which is substantially uniform (3) from said one end to said other end, said outer cross-section diverging outwardly along said mid longitudinal axis at said other end to form an expansion (4); and screw holding means (10) connected between said shell parts for holding said shell parts together to form said shell handle.

While specific embodiments of the invention have been shown and described in detail to illustrate the application of the principles of the invention, it will be understood that the invention may be embodied otherwise without departing from such principles.

What is claimed is:

1. A utility knife comprising:

a pair of shell parts engaged with each other to form a shell handle having an inner storage space for a plurality of cutting blades and an outer contour, said shell handle having a mid longitudinal axis and one end with a blade receiving channel for receiving a blade in a cutting position, said blade receiving channel extending at from about 5° to about 10° with respect to said mid longitudinal axis, said inner storage space being shaped to receive blades which lie perpendicularly to a blade in said blade receiving channel lying in said cutting position;

said shell handle having another end opposite from said one end with said blade receiving channel, said contour having an outer cross-section transverse to said mid longitudinal axis which is rounded and substantially uniform from said one end to said other end, said outer cross-section diverging outwardly along said mid longitudinal axis at said other end to form a substantially rectangular expansion; and screw holding means connected between said shell parts for holding said shell parts together to form said shell handle.

2. A utility knife according to claim 1, wherein said angle is between 5° and 8°.

3. A utility knife according to claim 1, including a plurality of blades in said storage space and a single blade in said receiving channel, said blade in said receiving channel being perpendicular to said blades in said storage space.

4. A utility knife according to claim 1, including connecting means connected between said shell parts at said other end of said shell handle for holding said shell parts together at said other end of said shell handle.

5. A utility knife according to claim 1, wherein said screw means comprises a knurled screw, at least one of said shell parts have a recess for receiving said knurled screw, said recess being open at sides of said shell handle and said knurled screw having an outer edge which projects through said openings of said recess and beyond said shell handle on opposite sides thereof.

6. A utility knife according to claim 5, wherein said knurled screw has a center of rotation which is positioned midway on said shell handle between said sides thereof.

7. A utility knife according to claim 6, wherein said knurled screw is positioned between said shell parts.

8. A utility knife according to claim 6, wherein said knurled screw has a threaded portion, one of said shell parts having a thread receiving portion for receiving said threaded portion of said knurled screw, said knurled screw being mounted for rotation and being axially fixed with respect to the other of said shell parts.

9. A utility knife according to claim 6, wherein said knurled screw has two engaging means thereon.

10. A utility knife according to claim 6, including an operating member movably mounted to said knurled screw, said shell part carrying said knurled screw having a recess for receiving said operating member.

11. A utility knife according to claim 1, including a first permanent magnet connected to one of said shell parts and communicating with said receiving channel for holding a blade thereof, and a second permanent magnet in one of said shell parts communicating with said inner space for holding a plurality of blades in said inner space.

12. In a floor covering cutter, particularly a carpet cutter for cutting floor coverings, having a shell handle made of several parts and a cutting blade that is gripped by the handle and extends at an angle of deployments with respect to a longitudinal axis of the shell handle between the shell parts, that are held together by a screw and defines a storage area inside for spare blades and a gripping contour outside, the improvement comprising the cutting blade (6) forms with astraight edge connecting with the cutting head (6*a*) a slight forward angle of deployment of from 5° to 10° with respect to a theorectical mid longitudinal axis (7) of the handle shell, and the handle shell in a mid-section thereof has a cross-section that extends substantially equally along the axes, the cross-section undergoing a transition at the end of the handle shell opposite the cutting blade into a section adjoining the gripping contour (3) that has an outer cross-section (4) that increases steadily on all sides to form an expansion, the handle shell in the gripping contour (3) having an approximately elliptical outer cross-section, and the expansion (4) of the outer cross-section of the handle shell on the end opposite from the cutting blade (6) having an outer cross-sectional contour that is roughly in the form of a rectangle, said blades in said storage area lying in a stack perpendicularly to said cutting blade at said one end of said shell handle.

13. A cutter according to claim 12, wherein the handle shell is made up of two shell parts (1,2) joined together by a joint on the end opposite from the cutting blade.

14. A cutter according to claim 12, wherein the two shell parts (1,2) are connected by a knurled screw (10) positioned in a recess (11) in one of the two shell parts (2), which screw projects with its edge beyond the contour of the handle shell on two sides diametrically opposite one another with respect to an axis of rotation of the knurled screw.

15. A cutter according to claim 12, wherein the edge of the knurled screw (10) is positioned approximately in the middle in the shell handle with respect to the axis of rotation of the screw (10) and extends beyond the shell handle on the side opposite the angle of deployment.

16. A cutter according to claim 12, including a permanent magnet (13,14) positioned in the handle shell at the cutting blade (6) and in the storage area (12) for spare cutting blades (6).

17. A cutter according to claim 15, including two engaging means on said knurled screw.

* * * * *